US009969596B2

(12) United States Patent
Cox et al.

(10) Patent No.: US 9,969,596 B2
(45) Date of Patent: May 15, 2018

(54) LOCKING ROTATING REEL ASSEMBLY

(71) Applicant: Vandor Corporation, Richmond, IN (US)

(72) Inventors: Gary L. Cox, Richmond, IN (US); Gerald H. Davis, Fountain City, IN (US)

(73) Assignee: Vandor Corporation, Richmond, IN (US)

( * ) Notice: Subject to any disclaimer, the term of this patent is extended or adjusted under 35 U.S.C. 154(b) by 427 days.

(21) Appl. No.: 14/819,750

(22) Filed: Aug. 6, 2015

(65) Prior Publication Data

US 2017/0036884 A1 Feb. 9, 2017

(51) Int. Cl.

| | |
|---|---|
| ***B65H 75/30*** | (2006.01) |
| ***B65H 49/32*** | (2006.01) |
| ***B65H 75/14*** | (2006.01) |

(52) U.S. Cl.

CPC ..... *B65H 75/30* (2013.01); *B65H 49/322* (2013.01); *B65H 49/324* (2013.01); *B65H 75/14* (2013.01); *B65H 2701/537* (2013.01)

(58) Field of Classification Search

CPC .. B65H 75/14; B65H 75/30; B65H 2701/537; B65H 49/322; B65H 49/324

See application file for complete search history.

(56) References Cited

U.S. PATENT DOCUMENTS

| | | | | |
|---|---|---|---|---|
| 5,529,186 | A * | 6/1996 | Bass | B65D 85/04 206/395 |
| 7,204,452 | B2 * | 4/2007 | Wilkinson | B65H 49/325 242/396.6 |
| 8,016,222 | B2 * | 9/2011 | Galgano | B62B 1/14 242/403 |
| 8,366,126 | B2 * | 2/2013 | Galgano | B62B 1/14 280/47.19 |
| 8,387,909 | B2 * | 3/2013 | Galgano | B62B 1/14 242/588.6 |
| 8,424,795 | B2 * | 4/2013 | Galgano | B62B 1/14 242/588.6 |
| 9,695,008 | B2 * | 7/2017 | Thakare | B65H 75/245 |
| 2010/0243784 | A1 * | 9/2010 | Johanson | B65H 49/322 242/422.4 |
| 2010/0320309 | A1 * | 12/2010 | Galgano | B65D 5/5028 242/588.3 |
| 2012/0153069 | A1 * | 6/2012 | Allwood | B65H 49/32 242/607 |
| 2012/0318939 | A1 * | 12/2012 | Galgano | B65D 85/04 248/127 |

(Continued)

*Primary Examiner* — William E Dondero

(74) *Attorney, Agent, or Firm* — Maginot, Moore & Beck LLP

(57) ABSTRACT

A reel assembly includes a core, two flanges, and two end stands. The core defines a longitudinal axis and has two ends. Each of the flanges is coupled to one of the ends of the core, and at least one of the flanges includes a lock receiver. Each of the end stands is coupled to one flange, and at least one of the end stands includes a lock insert. The lock insert is configured to be inserted into the lock receiver in an axial direction. When the lock insert is within the lock receiver, contact between the lock insert and the lock receiver generates a frictional force against movement of the flanges relative to the end stands in a rotational direction orthogonal to the axial direction.

18 Claims, 11 Drawing Sheets

(56) References Cited

U.S. PATENT DOCUMENTS

| | | | | |
|---|---|---|---|---|
| 2016/0251196 | A1* | 9/2016 | Thakare | B65H 75/22<br>242/609 |
| 2016/0347573 | A1* | 12/2016 | Runzel | B62B 3/005 |
| 2017/0158454 | A1* | 6/2017 | Thakare | B65H 75/22 |
| 2017/0158455 | A1* | 6/2017 | Thakare | B65H 75/30 |

* cited by examiner

LOCKING ROTATING REEL ASSEMBLY

TECHNICAL FIELD

This application relates to reel assemblies used for supporting and/or storing flexible media.

BACKGROUND

Reels used for storage and transportation of flexible string-like media, such as cord, wire, thread, cable, chain, and other slender, elongated, flexible materials, generally include a core, around which the string-like material is wound, and flanges on each end of the core, to retain the string-like material on the core between the ends.

In industrial applications, large quantities of flexible media are used, and may be wound onto or off of reels by machinery at high rates of speed. Reels intended for industrial transportation, storage, and use of flexible media vary greatly in size and have traditionally been fabricated out of wood or metallic material. More recently, reels have been fabricated from paper and plastic products to reduce the weight of the reel.

Ideally, a reel combines structural strength with convenience and economy of manufacture. One development in the reel industry that has increased convenience is the rotating reel assembly. A rotating reel is a reel that is rotatably connected to a frame structure and is typically enclosed in a box. The rotating reel permits the user of the flexible media to unwind the flexible media from the reel at any location without the need for special fixtures on which to mount the reel.

One disadvantage of known rotating reels is that, during transportation, the rotating reel can rotate relative to the frame structure, unintentionally unwinding flexible media from the reel. Another disadvantage of known rotating reels is that coupling the rotating reel to the frame structure can be a difficult task.

A need therefore exists for a rotating reel assembly, including a rotating reel and a frame structure, which can be easily assembled. A further need exists for a rotating reel assembly in which the rotating reel can be fixed relative to the frame structure to prevent unintentional unwinding of flexible media from the reel.

SUMMARY

The present application discloses an improved reel assembly including a core, two flanges, and two end stands. The core has two ends and a longitudinal axis, and one flange is fixedly coupled to each of the ends of the core in an axial direction. Each of the two end stands is rotationally coupled to one of the flanges to rotationally support the core and the flanges of the reel assembly. The end stands are coupled to the flanges in the axial direction. At least one of the flanges includes a lock receiver, and at least one of the end stands includes a lock insert configured to be received within the lock receiver by moving the lock insert in the axial direction. When the lock insert is received within the lock receiver, a frictional force generated by contact of the lock insert within the lock receiver resists movement of the flanges and the core relative to the end stands in a rotational direction that is orthogonal to the axial direction. To remove the lock insert from the lock receiver, rotational force applied in the rotational direction to the flanges and the core must exceed the frictional force resisting movement of the flanges and the core in the rotational direction. When the rotational force is greater than the frictional force, the lock insert is removed from the lock receiver in the rotational direction.

DETAILED DESCRIPTION

Figure 1:
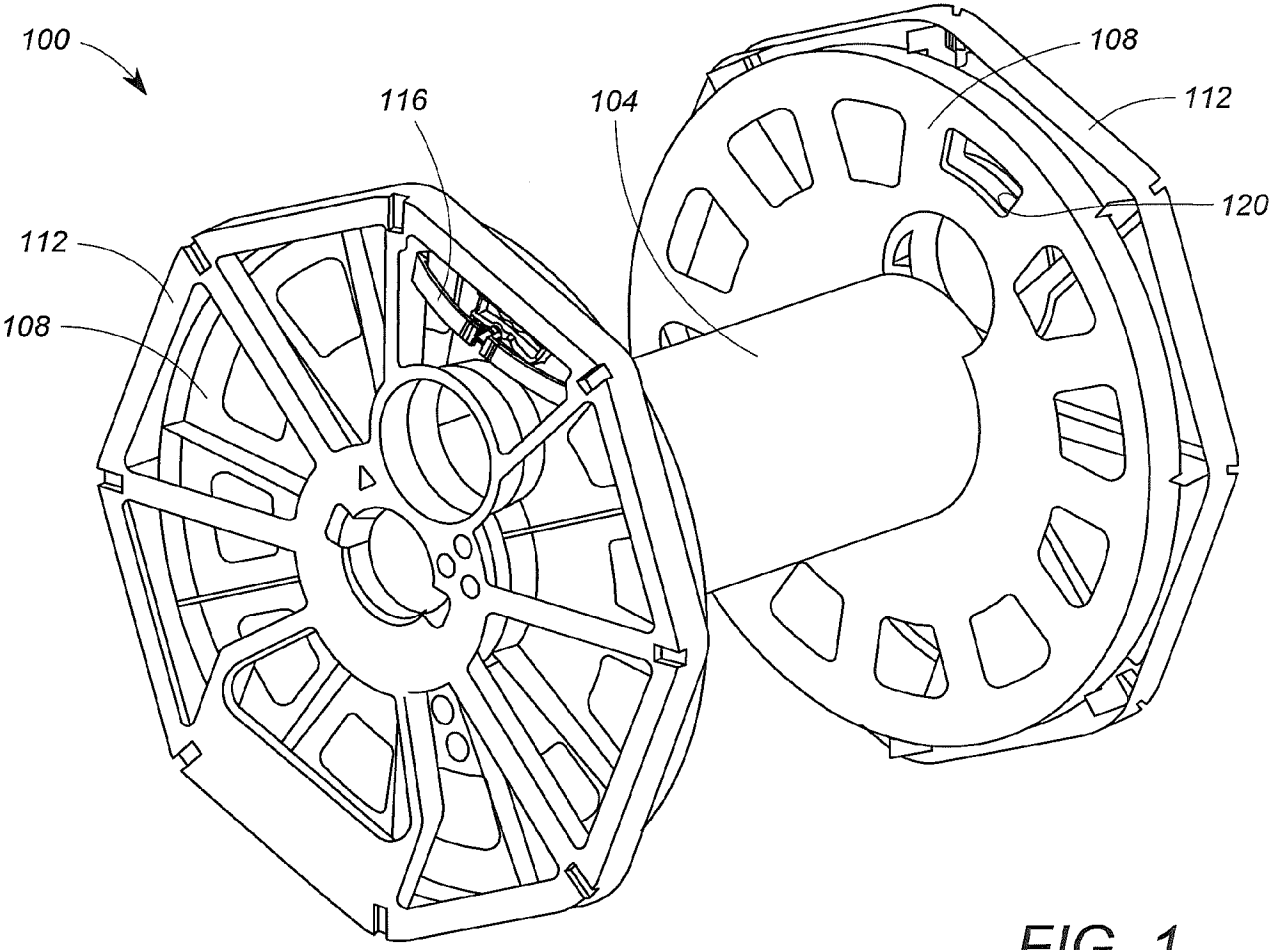
FIG. 1 depicts a perspective view of a reel assembly including a core, flanges, and end stands.

The reel assembly 100, shown in FIG. 1, includes a cylindrical core 104, two flanges 108, one coupled to each end of the core 104, and two end stands 112, one coupled to each of the flanges 108 opposite the core 104. The core 104 is fixedly suspended between the two flanges 108, and each of the flanges 108 is rotatably supported by an end stand 112. Each of the end stands 112 includes a lock insert 116 which projects inwardly toward the flanges 108 and the core 104. Each of the flanges 108 includes a lock receiver 120 configured to receive the lock insert 116 on a respective end stand 112. When the lock inserts 116 are not received within the lock receivers 120, the flanges 108 are free to rotate on the end stands 112, enabling the core 104 to also rotate relative to the end stands 112. Conversely, when the lock inserts 116 are received within the lock receivers 120, the flanges 108 are locked into a fixed rotational position relative to the end stands 112, and rotation of the flanges 108 and the core 104 within the end stands 112 is resisted.

Figure 2:
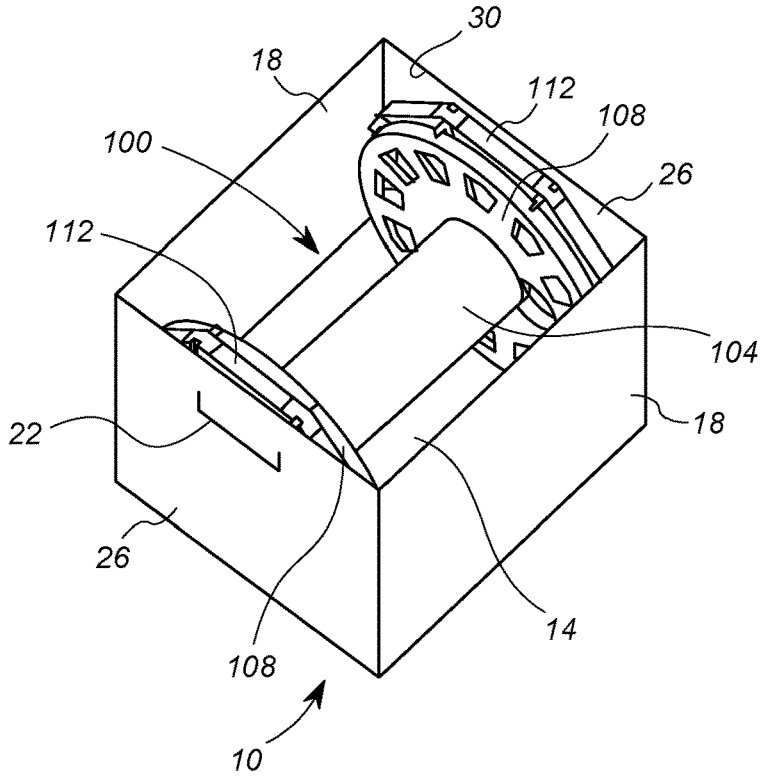
FIG. 2 depicts a perspective view of the reel assembly of FIG. 1 received within a container.

As shown in FIG. 2, for use, the reel assembly 100 is configured to fit within a container 10 such that the reel assembly 100 is supported by the end stands 112, which contact a bottom 14 and sides 18 of the container 10, while the core 104 and flanges 108 are free to rotate. Accordingly, the container 10 is sized such that the end stands 112 of the reel assembly 100 are held in a fixed position by the bottom 14 and sides 18 of the container 10 while wire (not shown) is unwound from the core 104 and/or wound onto the core 104. Wire, as used herein, can refer to cable, rope, line, cord, or any other slender, elongated, string-like piece or filament of relatively flexible material. This configuration is advantageous because the container 10 retains the reel assembly 100 in a fixed location while enabling use of the reel assembly 100. The container 10 also includes a handle 22 on each end 26 (only one handle 22 is shown in FIG. 2) to enable a user to lift the container 10, including the reel assembly 100 disposed inside, and transport it to a desired location for use. To prevent the core 104 and the flanges 108 from unintentionally rotating relative to the end stand 112, thereby unintentionally winding or unwinding the wire from the core 104, the flanges 108 are locked into the fixed rotational position relative to the end stands 112, as mentioned above, when the reel assembly 100 is assembled and inserted into the container 10, and remain locked until intentionally unlocked by a user.

Figure 3:
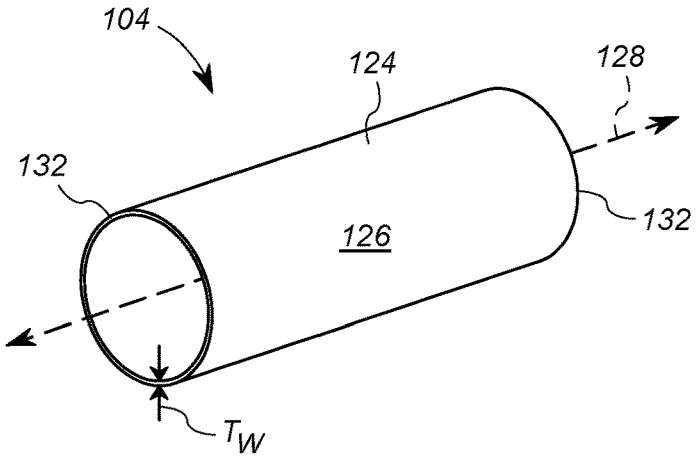
FIG. 3 depicts a perspective view of the core of the reel assembly of FIG. 1.

As shown in FIG. 3, the core 104 includes a cylindrical body 124 having an outer surface 126, defining a longitudinal axis 128 therethrough, and two ends 132 formed on opposite ends of the core 104. The longitudinal axis 128 defines an axial direction of the reel assembly 100 in the direction of extension of the longitudinal axis 128. A rotational direction of the reel assembly 100 is orthogonal to the axial direction and extends in the direction around the axial direction. In other words, the rotational direction of the reel assembly 100 is the direction of rotation of the core 104 and flanges 108 relative to the end stands 112.

The outer surface 126 of the core 104 is formed as a cylinder to provide a smooth, round member around which wire can be wrapped for storage and unwrapped for use. The core 104 is hollow, such that the member supporting the wire is lightweight. In other words, the body 124 is formed as a curved wall in a hollow cylindrical shape. The body 124 is made of a strong, lightweight material, such as a plastic. For example, the core 104 can be made of polypropylene. The curved wall of the body 124 has a thickness $T_W$ which is thick enough to provide adequate structural integrity to the body 124 to enable the core 104 to support the wire, and is also thin enough to enable the core 104 to be a lightweight member.

Figure 4:
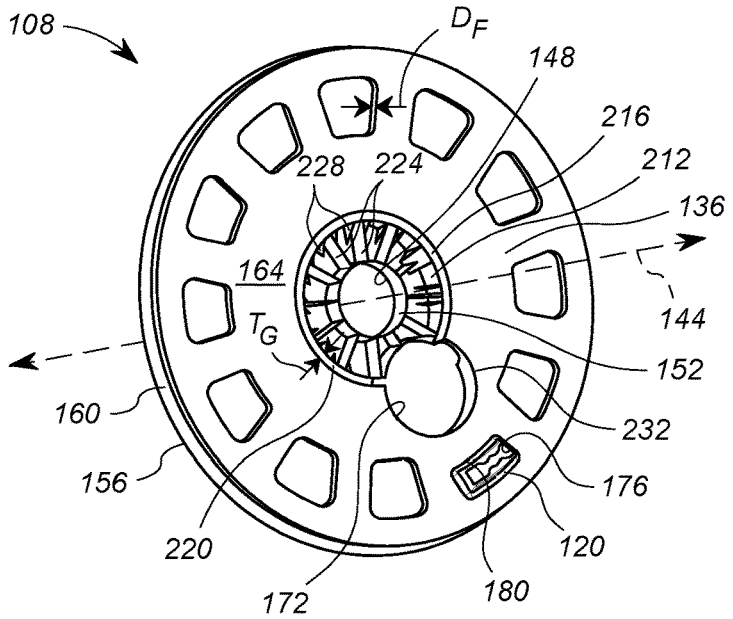
FIG. 4 depicts a right side perspective view of one of the flanges of the reel assembly of FIG. 1.
Figure 5:
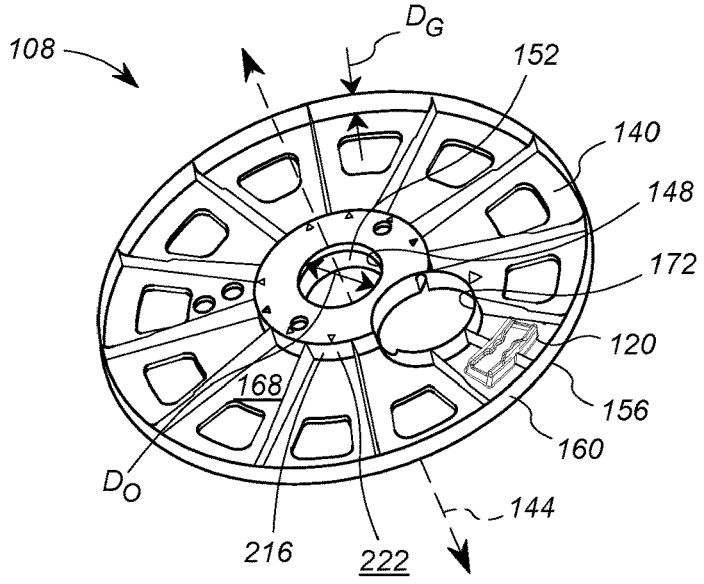
FIG. 5 depicts a left side perspective view of one of the flanges of the reel assembly of FIG. 1.

Turning now to FIGS. 4 and 5, one of the flanges 108 is shown. Both of the flanges 108 are identical to one another, so the description of the flange 108 shown in FIGS. 4 and 5 applies to both flanges 108 of the reel assembly 100 (shown in FIG. 1). The flange 108 is shaped as a disk, including an inside 136 (shown in FIG. 4), which faces toward the core 104 (shown in FIG. 3) when the reel assembly 100 is assembled as shown in FIG. 1, and an outside 140 (shown in FIG. 5), which faces away from the core 104 and toward the respective end stand 112 (shown in FIG. 1) when the reel assembly 100 is assembled. Each of the flanges 108 are coupled to the core 104 in the axial direction.

The disk shape of the flange 108 defines a rotational axis 144, which lies at the center of the flange 108, and is coaxial with the longitudinal axis 128 of the core 104 when the reel assembly 100 is assembled as shown in FIG. 1. The flange 108 includes an innermost opening 148, which is formed concentrically around the rotational axis 144 and is bordered by an innermost opening wall 152, a circular perimeter 156, which is equidistant at every point from the rotational axis 144, and an outermost wall 160, which is formed along the circular perimeter 156. The flange 108 has a depth $D_F$ (shown in FIG. 4), which extends from an inside surface 164 on the inside 136 to an outside surface 168 on the outside 140 of the flange 108. The flange 108 also has a further depth $D_G$ (shown in FIG. 5), which projects beyond the depth $D_F$ of the flange 108. The innermost opening wall 152 and the outermost wall 160 both project the further depth $D_G$ in a direction from the inside surface 164 toward the outside surface 168 of the flange 108. Because they project the further depth $D_G$, the innermost opening wall 152 and outermost wall 160 have greater strength than surrounding areas having the depth $D_F$.

The flange 108 further includes the lock receiver 120 and an offset opening 172. The lock receiver 120 includes a substantially rectangularly shaped rectangular opening 176 on the inside surface 164 of the flange 108 (shown in FIG. 4) and side walls 180, which project the further depth $D_G$ from the rectangular opening 176 in the direction from the inside surface 164 toward the outside surface 168 of the flange 108 (shown in FIG. 5). The offset opening 172 is arranged between the innermost opening 148 and the lock receiver 120 and is configured to pass a starting end of the wire therethrough. The starting end of the wire is the end of the wire that is in contact with the outer surface 126 of the core 104 when the wire is wrapped around the core 104.

Figure 6A:
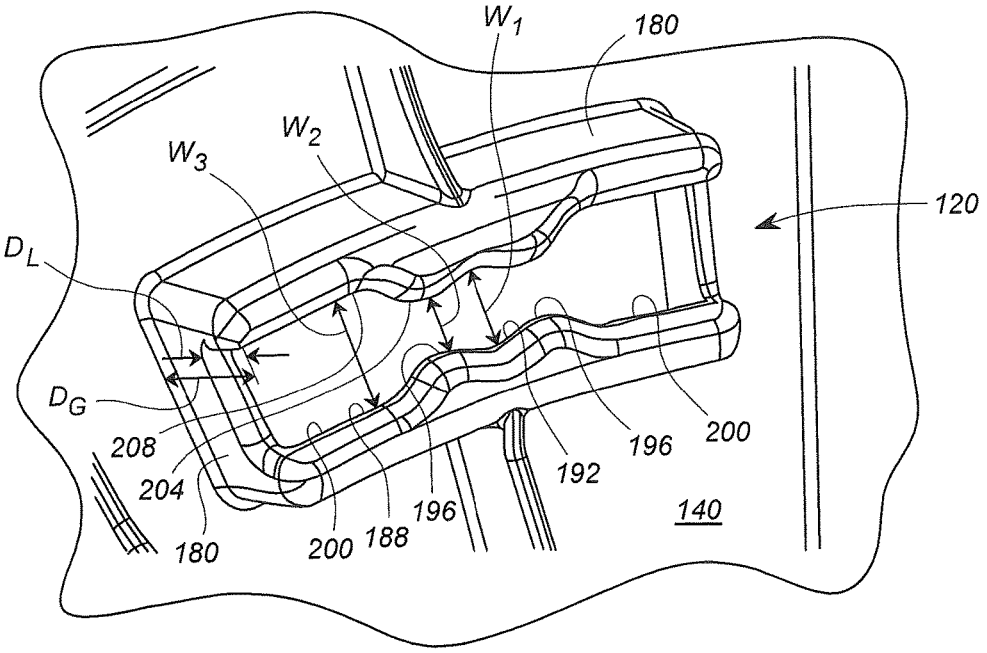
FIG. 6A depicts a partial left side perspective view of one of the flanges of the reel assembly of FIG. 1.
Figure 6B:
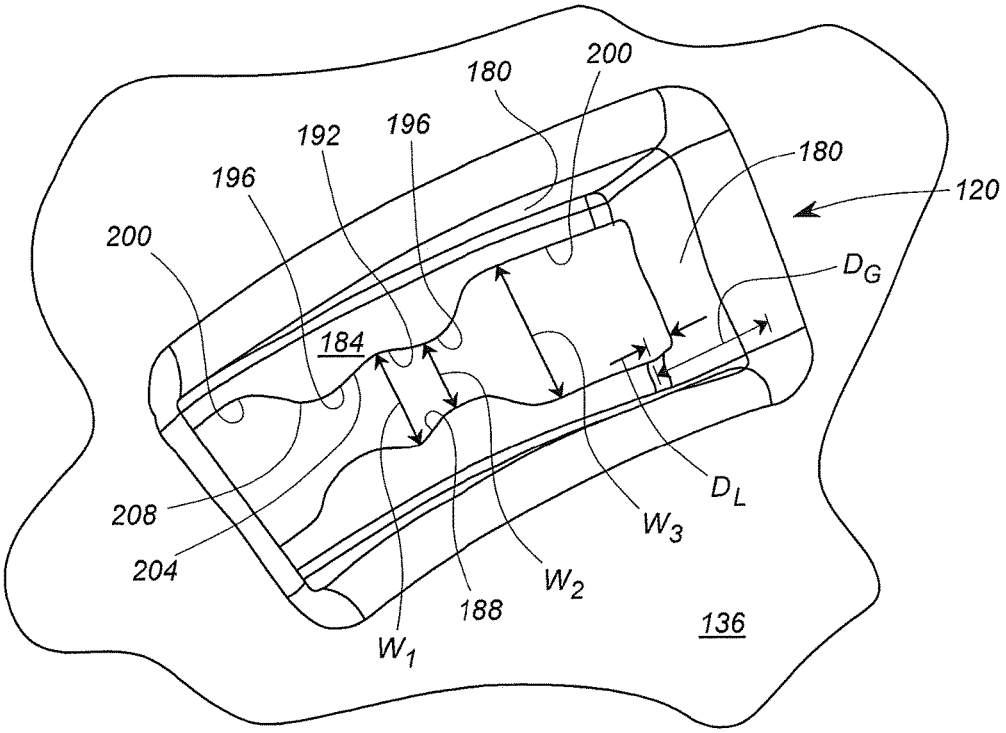
FIG. 6B depicts a partial right side perspective view of one of the flanges of the reel assembly of FIG. 1.

The lock receiver 120 is shown in more detail from the outside 140 of the flange 108 in FIG. 6A and from the inside 136 of the flange 108 in FIG. 6B. The lock receiver 120 includes a locking surface 184 (shown in FIG. 6B) formed at the depth $D_G$ from the rectangular opening 176 on the inside 136 of the flange 108. In other words, the locking surface 184 of the lock receiver 120 is arranged facing away from the end stand 112 when the reel assembly 100 is assembled as shown in FIG. 1. The locking receiver 120 further includes a contoured opening 188 configured to removably receive the lock insert 116 (shown in FIG. 1). To this end, the contoured opening 188 includes a first portion, called a central portion 192, which is substantially circular in shape, two second portions, called pinched portions 196, one on each side of the central portion 192 and in open communication therewith, and two third portions, called lateral portions 200, one on the side of each of the pinched portions 196 opposite the central portion 192. The lateral portions 200 are formed not only in the locking surface 184, but also in the short side walls 180 of the lock receiver 120. The lateral portions 200 include a depth $D_L$ projecting into the short side walls 180 from the locking surface 184.

The central portion 192 has a first opening width W1, the pinched portions 196 have a second opening width W2, which is smaller than the first opening width W1, and the lateral portions 200 have a third opening width W3, which is larger than both the second opening width W2 and the first opening width W1. The contoured opening 188 further includes a first transition 204, formed between the central portion 192 and each of the pinched portions 196, and a second transition 208, formed between each of the pinched portions 196 and the respective lateral portion 200. The transitions 204, 208 provide curved surfaces which enable a smooth transition of the lock insert 116 (shown in FIG. 1) between each of the portions of the contoured opening 188.

The contoured opening 188 also includes curved surfaces formed on the outside 140 of the flange 108 along the central portion 192, the pinched portions 196, and the lateral portions 200. These curved surfaces enable a smooth transition of the lock insert 116 from outside the contoured opening 188 to inside the contoured opening 188 and help to guide the lock insert 116 toward the central portion 192 of the contoured opening 188. However, the inside surface 136 of the flange 108 includes no such curved surfaces. Instead, the edges of the contoured opening 188 are flat on the locking surface 184. Thus, the contoured opening 188 is shaped to facilitate insertion of the lock insert 116 into the locking receiver 120 and not to facilitate removal of the lock insert 116 from the locking receiver 120.

In an alternative embodiment, the contoured opening 188 can include just one pinched portion 196 and one lateral portion 200. In this embodiment, the pinched portion 196 is interposed between the central portion 192 and the lateral portion 200. In this embodiment, the pinched portion 196 is adjacent to a side of the central portion 192 in the rotational direction. In particular, the pinched portion 196 is adjacent to a side of the central portion 192 that is opposite the direction in which the wire is pulled to unwind the wire from the flanges 108 and core 104 of the reel assembly 100. Accordingly, in this embodiment, the lateral portion 200 is adjacent to the side of the pinched portion 196 that is opposite the direction in which the wire is pulled to unwind the wire from the reel assembly 100.

Returning now to FIG. 4, the inside 136 of the flange 108 includes an inner core engaging wall 212 and an outer core engaging wall 216 which are formed concentrically between the innermost opening wall 152 and the outermost wall 160 such that the inner core engaging wall 212 is nearer to the innermost opening wall 152 and the outer core engaging wall 216 is nearer to the outermost wall 160. The inner core engaging wall 212 and the outer core engaging wall 216 both project the further depth $D_G$ (shown in FIG. 5) in the direction from the inside surface 164 toward the outside surface 168 of the flange 108. The inner core engaging wall 212 and the outer core engaging wall 216 are spaced apart from one another by a gap 220 having a thickness $T_G$. The thickness $T_G$ of the gap 220 is slightly larger than the thickness $T_W$ of the curved wall of the body 124 of the core 104 (shown in FIG. 3) to enable the flange 108 to receive the ends 132 of the curved wall of the body 124 core 104 between the inner core engaging wall 212 and the outer core engaging wall 212 when the reel assembly 100 is assembled as shown in FIG. 1.

The further depth $D_G$ (shown in FIG. 5) of the inner core engaging wall 212 and the outer core engaging wall 216 provides contact surface area between the flange 108 and the core 104 to promote retention of the core 104 on the flange 108 in the axial direction. To further promote retention of the core 104 on the flange 108, the core 104 can also be coupled to the flange 108 by, for example press-fitting, gluing, or stapling the core 104 to at least one of the inner core engaging wall 212 and the outer core engaging wall 216. In at least one embodiment, the core 104 can be further fastened to the flange 108 by inserting fasteners (not shown) through the outer core engaging wall 216 via an outer surface 222 (shown in FIG. 5) of the outer core engaging wall 216, through the body 124 of the core 104, and through the inner core engaging wall 212. These fasteners are inserted in a radial direction toward the longitudinal axis 128 of the core 104. The radial direction is orthogonal to the axial direction and extends toward and away from the longitudinal axis 128. The core 104 can be coupled to the flange 108 in any way which fixes the core 104 rotationally with respect to the flange 108 between the inner core engaging wall 212 and the outer core engaging wall 216.

The flange 108 includes inner ribs 224 extending in the radial direction along the inside surface 164 from the innermost opening wall 152 to the inner core engaging wall 212 to provide additional strength and structural support to both the innermost opening wall 152 and the inner core engaging wall 212 Like the innermost opening wall 152 and the inner core engaging wall 212, the inner ribs 224 project the further depth $D_G$ (shown in FIG. 5) from the inside surface 164 of the flange 108. The inner ribs 224 are spaced in the rotational direction at substantially equal intervals around the innermost opening 148 so that the inner ribs 224 are symmetrically arranged about the innermost opening 148. In the embodiment shown, the flange 108 includes twelve inner ribs 224. However, it is possible for the flange 108 to include more or fewer than twelve inner ribs 224 to provide additional strength and structural support to both the innermost opening wall 152 and the inner core engaging wall 212.

In contrast to the inner ribs 224, which contact both the innermost opening wall 152 and the inner core engaging wall 212, the flange 108 also includes partial ribs 228, which extend in the radial direction from the inner core engaging wall 212 but do not contact the innermost opening wall 152. The partial ribs 228 extend along the inside surface 164 of the flange 108 and project from the inside surface 164 to the further depth $D_G$ (shown in FIG. 5) at the inner core engaging wall 212. The partial ribs 228 then decrease in depth as they extend away from the inner core engaging wall 212 such that the partial ribs 228 form triangles between the inside surface 168 to the inner core engaging wall 212. Like the inner ribs 224, the partial ribs 228 provide additional strength and structural support to the inner core engaging wall 212.

The partial ribs 228 are arranged such that a pair of partial ribs 228 is associated with a respective inner rib 224. However, not all inner ribs 224 have a pair of partial ribs 228 associated therewith. Between two adjacent inner ribs 224 which each do have a pair of partial ribs 228 associated therewith, there are two partial ribs 228 between the adjacent inner ribs 224. In the embodiment shown, the flange 108 includes eighteen partial ribs associated with nine inner ribs 224. The remaining inner ribs 224 which do not have partial ribs 228 associated therewith are adjacent to the offset opening 172.

The offset opening 172, arranged between the innermost opening 148 and the lock receiver 120, is circularly shaped and overlaps with the inner core engaging wall 212 and the outer core engaging wall 216 such that the inner core engaging wall 212 and outer core engaging wall 216 do not form complete circles. The offset opening 172 is formed on the inside surface 164 of the flange 108 and includes an offset opening wall 232 which projects from the outside surface 168 of the flange 108 (shown in FIG. 5) at the further depth $D_G$. The offset opening wall 232 intersects with one of the inner ribs 224 and is positioned between the two adjacent inner ribs 224. These three inner ribs 224 do not have partial ribs 228 associated therewith.

Figure 7:
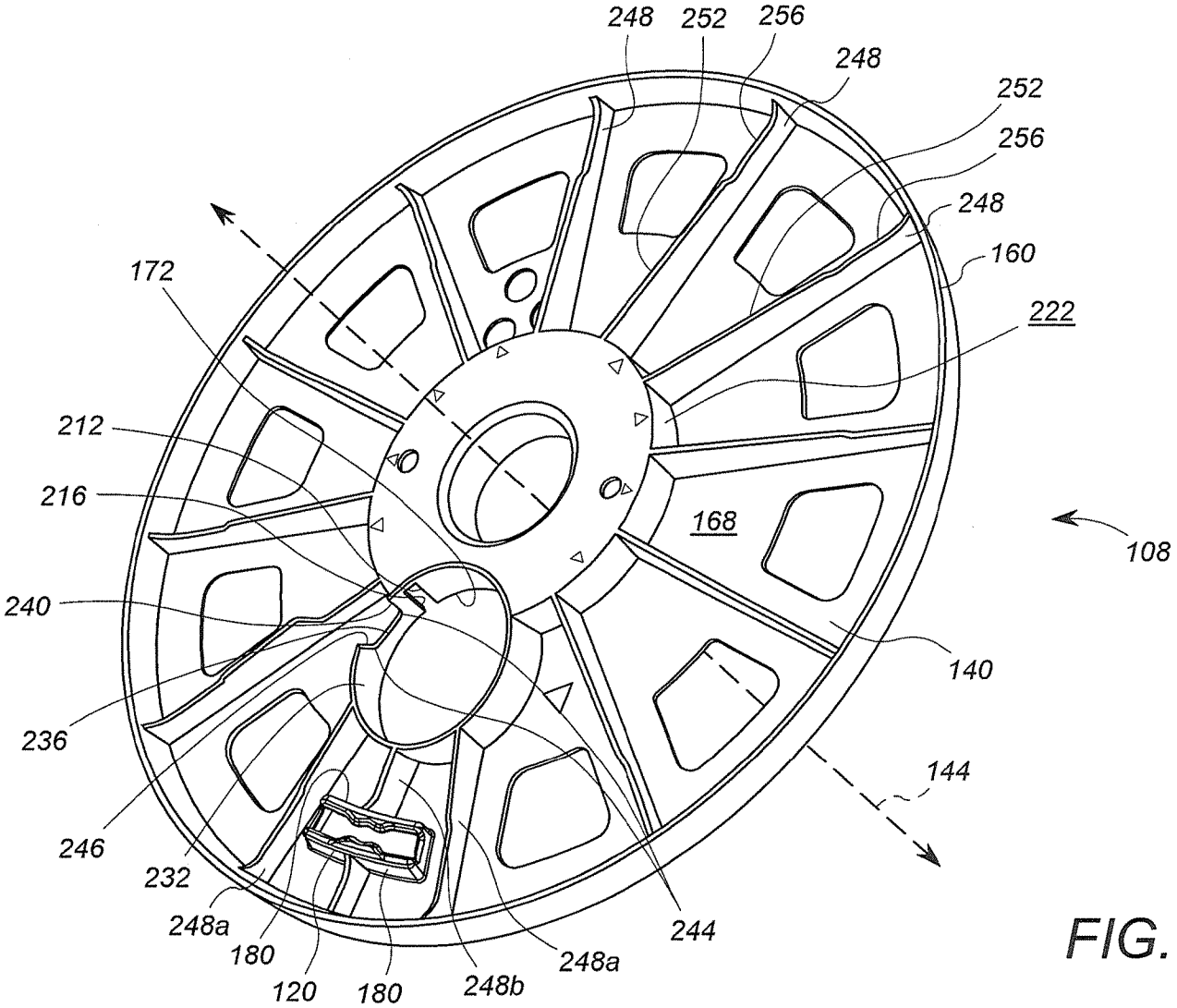
FIG. 7 depicts a left side perspective view of one of the flanges of the reel assembly of FIG. 1.

As shown in FIG. 7, the offset opening wall 232 includes a substantially rectangularly shaped notch 236 formed opposite the outside surface 168 of the flange 108. The notch 236 is configured to receive the starting end of the wire supported on the surface of the core 104 (shown in FIG. 3) which is passed from the inside 136 (shown in FIG. 4) to the outside 140 of the flange 108. To this end, the notch 236 includes an open side 240 facing away from the outside surface 168 of the flange 108 to enable the wire to enter the notch 236. Additionally, the notch 236 includes curved corners 244 to prevent the corners of the notch 236 from snagging or damaging the wire as it passes through the notch 236. The notch 236 also includes a guide edge 246 configured to guide the staring end of the wire when the wire is being wound back onto the core 104 to prevent the starting end of the wire from becoming trapped between the flange 108 and the end stand 112 and blocking rotation of the flange 108 with respect to the end stand 112. The notch 236 is formed in the offset opening wall 232 near the outer core engaging wall 216 but outside the area of the offset opening wall 232 which overlaps with the inner core engaging wall 212 and the outer core engaging wall 216.

With continued reference to FIG. 7, the outside 140 of the flange 108 includes a plurality of outer ribs 248 extending in the radial direction from the outer surface 222 of the outer core engaging wall 216 to the outermost wall 160. Each of the outer ribs 248 extends along the outer surface 168 of the flange 108 and includes a top edge 252 facing away from the outer surface 168 of the flange 108. At the outer surface 222 of the outer core engaging wall 216, the outer ribs 248 project the further depth $D_G$ (shown in FIG. 5) from the outer surface 168 of the flange 108. The depth of each of the outer ribs 248 varies from the outer surface 222 of the outer core engaging wall 216 to the outermost wall 160 and is less than the further depth $D_G$ at the outermost wall 160. Each of the outer ribs 248 includes an indentation 256 formed in the top edge 252 and configured to enable the outer ribs 248 to pass by the lock insert 116 (shown in FIG. 1) without interference when the reel assembly 100 is assembled as shown in FIG. 1 and the flange 108 is rotated relative to the end stand 112. The indentations 256 are aligned radially with the central portion 192 of the lock receiver 120 (shown in FIG. 6). In other words, the indentations 256 are the same distance from the rotational axis 144 as the central portion 192. The outer ribs 248 are configured to provide strength and structural support to the flange 108 between the outer core engaging wall 216 and the outermost wall 160.

In the embodiment shown, the flange 108 includes thirteen outer ribs 248. Twelve of the outer ribs 248 are spaced in the rotational direction at substantially equal intervals around the innermost opening 148 so that those twelve outer ribs 248 are symmetrically arranged about the innermost opening 148. Two of those twelve outer ribs 248 are interrupted outer ribs 248*a*, which are interrupted by the offset opening 172 and offset opening wall 232. Accordingly, the two interrupted outer ribs 248*a* do not extend all the way from the outer surface 222 of the outer core engaging wall 216 to the outermost wall 160, but only extend from the outermost wall 160 to the offset opening wall 232. The thirteenth outer rib 248 is a twice-interrupted outer rib 248*b* and is spaced substantially equally between the interrupted outer ribs 248*a*. The twice-interrupted outer rib 248*b* is interrupted by both the offset opening 172 and the lock receiver 120. Accordingly, the twice-interrupted outer rib 248*b* extends from the outermost wall 160 to the outermost side wall 180 of the lock receiver 120 and from the innermost side wall 180 of the lock receiver 120 to the offset opening wall 232. The twice-interrupted outer rib 248*b* provides additional strength and structural support to the lock receiver 120 on the flange 108.

In alternative embodiments, the flange 108 can include more or fewer than thirteen outer ribs 248, and the outer ribs 248 can be evenly or unevenly spaced. Additionally, the flange 108 can include more or fewer than two interrupted outer ribs 248*a* and more or fewer than one twice-interrupted outer rib 248*b*. The number and spacing of each of the outer ribs 248, the interrupted outer ribs 248*a*, and the twice-interrupted outer ribs 248*b* is determined in order to provide sufficient strength and structural support to the outer core engaging wall 216, the outermost wall 160, the offset opening wall 232, and the lock receiver 120 of the flange 108 during use of the reel assembly 100 (shown in FIG. 1).

Figure 8:
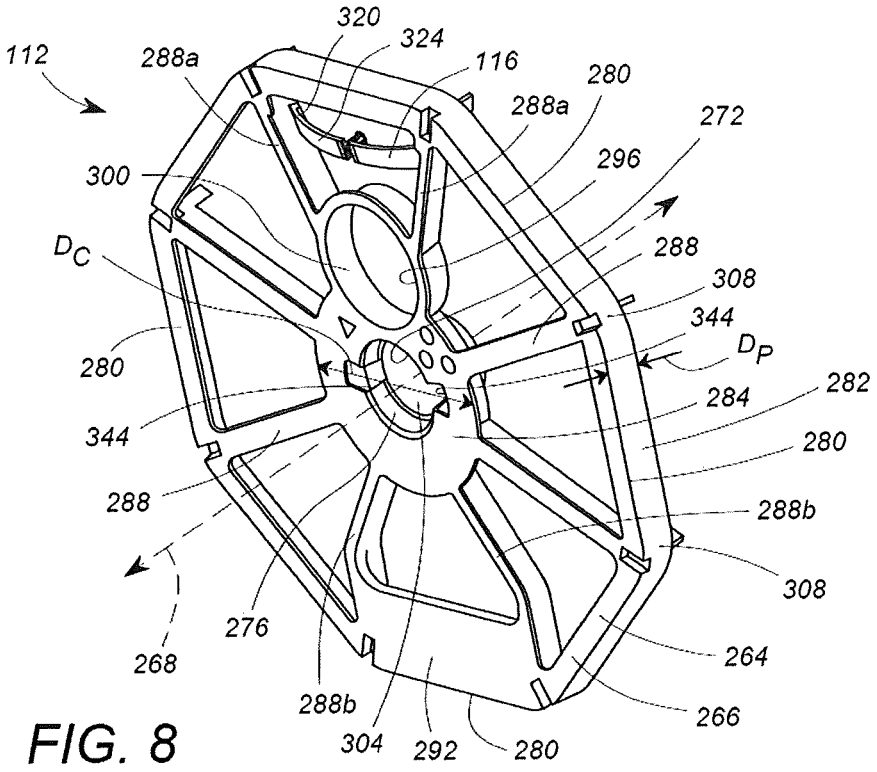
FIG. 8 depicts a left side perspective view of one of the end stands of the reel assembly of FIG. 1.
Figure 9:
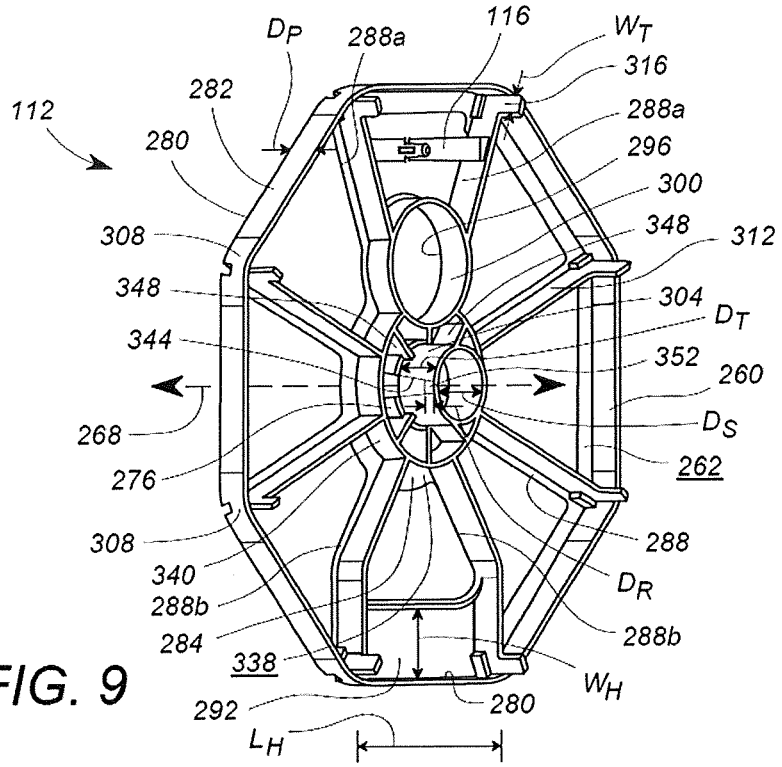
FIG. 9 depicts a right side perspective view of one of the end stands of the reel assembly of FIG. 1.

Turning now to FIGS. 8 and 9, one of the end stands 112 is shown. Both of the end stands 112 are identical to one another, so the description of the end stand 112 shown in FIGS. 8 and 9 applies to both end stands 112 of the reel assembly 100. The end stand 112 is shaped as an octagon, including an inside 260 (shown in FIG. 9), which faces toward the flanges 108 (shown in FIGS. 4 and 5) and the core 104 (shown in FIG. 3), and an outside 264 (shown in FIG. 8), which faces away from the core 104 and the flanges 108 when the reel assembly 100 is assembled as shown in FIG. 1. The inside 260 defines an inside surface 262 and the outside 264 defines an outside surface 266 of the end stand 112.

The octagonal shape of the end stand 112 defines a rotational axis 268, which lies at the center of the end stand 112, and is coaxial with both the longitudinal axis 128 of the core 104 (shown in FIG. 3) and the rotational axis 144 of the flange 108 (shown in FIGS. 4 and 5) when the reel assembly 100 is assembled as shown in FIG. 1. As shown in FIG. 8, the end stand 112 also includes an innermost opening 272, which is formed concentrically around the rotational axis 268 and is bordered by an innermost opening wall 276, and eight flat perimeter edges 280, which form the outer perimeter of the end stand 112.

The end stand 112 further includes a hub 284 formed around the innermost opening wall 276 and eight spokes 288 projecting in the radial direction from the hub 284 toward the perimeter edges 280. The end stand 112 also includes the lock insert 116, a handle portion 292, which projects toward the hub 284 from one of the perimeter edges 280 opposite the lock insert 116, an offset opening 296, which is arranged between the innermost opening 272 (shown in FIG. 8) and the lock insert 116 and includes an offset opening wall 300, and a seat 304, which projects from the innermost opening wall 276.

Each of the flat perimeter edges 280 includes a perimeter wall 282 projecting a depth $D_P$ from the inside surface 262 (shown in FIG. 9) in the axial direction away from the outside 264 (shown in FIG. 8) of the end stand 112. The end stands 112 are configured to stand on the perimeter walls 282 to stably support the reel assembly 100 when the reel assembly 100 is assembled as shown in FIG. 1 and arranged within the container 10 as shown in FIG. 2. The octagonal shape is particularly advantageous because it provides a perimeter wall 282 to contact the bottom 14 and each of the sides 18 of the container 10 (shown in FIG. 2) to provide contact with three surfaces to prevent the end stand 112 from rotating relative to the container 10. Additionally, the perimeter walls 282 which do not contact the bottom 14 and sides 18 of the container 10 provide clearance between the corners of the container 10 and the end stand 112 to facilitate easy insertion of the reel assembly 100 into the container 10. In alternative embodiments, the end stand 112 can include more or fewer than eight flat perimeter edges 280 and, thus, more or fewer than eight perimeter walls 282. In other words, the end stands 112 can have polygonal shapes other than octagons. However, the two end stands 112 of the reel assembly 100 have the same shape.

The perimeter edges 280 are equal to one another in length and meet at equal angles at corners 308. In other words, the perimeter edges 280 form a regular octagon. The perimeter edges 280 of the end stand 112 are large enough so that when the reel assembly 100 is assembled as shown in FIG. 1, the perimeter walls 282 are positioned outside of the outermost wall 160 of the flange 108 in the radial direction. In other words, when the reel assembly 100 is assembled, the perimeter walls 282 of the end stand 112 are farther from the longitudinal axis 128 of the core 104 than the outermost wall 160 of the flange 108.

As shown in FIG. 9, each of the spokes 288 includes a spoke rib 312 which projects the depth $D_P$ from the inside surface 262 of the end stand 112 in the axial direction away from the outside 264 (shown in FIG. 8) of the end stand 112. The spoke ribs 312 provide strength and structural support to the spokes 288, the hub 284, and the perimeter edges 280 of the end stand 112. Each of the spoke ribs 312 extends along a respective spoke 288 and includes a tab 316 projecting further than the depth $D_P$ from the spoke rib 312 in the axial direction away from the outside 264 (shown in FIG. 8) of the end stand 112. The tabs 316 are arranged adjacent to the perimeter walls 282 and have a width $W_T$ extending from the perimeter walls 282 toward the hub 284. The width $W_T$ is sized such that, when the reel assembly 100 is assembled as shown in FIG. 1, the tabs 316 are arranged outside of the outermost wall 160 of the flange 108 in the radial direction. The tabs 316 are configured to retain the outermost wall 160 of the flange 108 within the end stand 112 without interfering with the flange 108. This configuration helps prevent the flange 108 from being unintentionally removed from the end stand 112 and helps prevent the flange 108 from contacting the bottom 14 and sides 18 of the container 10 (shown in FIG. 2) to prevent friction between the flange 108 and the container 10 during use.

With continued reference to FIGS. 8 and 9, the lock insert 116 is arranged between two lock insert spokes 288*a* of the spokes 288, the offset opening 296 is arranged between the same two lock insert spokes 288*a*, and the handle portion 292 is arranged between two handle spokes 288*b* of the spokes 288. The handle spokes 288*b* are arranged opposite the lock insert spokes 288*a* on the opposite side of the hub 284 such that the lock insert 116 and the offset opening 296 are arranged on one side of the hub 284 and the handle portion 292 is arranged on the opposite side of the hub 284.

The spokes 288, including the lock insert spokes 288*a*, but not the handle spokes 288*b*, intersect with the perimeter edges 280 at the corners 308. Thus, six of the corners 308 are intersected by one of a spoke 288 and a lock insert spoke 288*a*. Accordingly, the spokes 288, including the lock insert spokes 288*a*, but not the handle spokes 288*b* are symmetrically spaced in the rotational direction around the innermost opening 272 of the end stand 112. The lock insert spokes 288*a* are interrupted by the offset opening 296 such that the lock insert spokes 288*a* do not extend all the way from the corners 308 to the hub 284. Instead, the lock insert spokes 288*a* extend in the radial direction from the corners 308 to the offset opening wall 300.

The offset opening 296 of the end stand 112 is sized and configured to align with the offset opening 172 of the flange 108 (shown in FIGS. 4 and 5) when the lock receiver 120 (shown in FIGS. 4 and 5) is aligned with the lock insert 116. Thus, when the lock insert 116 is received within the lock receiver 120 in the axial direction to rotationally lock the flange 108 with respect to the end stand 112, the offset opening 296 and the offset opening 172 provide a passage through the end stand 112 and the flange 108 to the outer surface 126 of the core 104 (shown in FIG. 3). This passage enables reaching the outer surface 126 of the core 104 from the outside 264 of the end stand 112 to hold the starting end of the wire onto the outer surface 126 prior to the wire being initially wound onto the core 104.

Figure 10A:
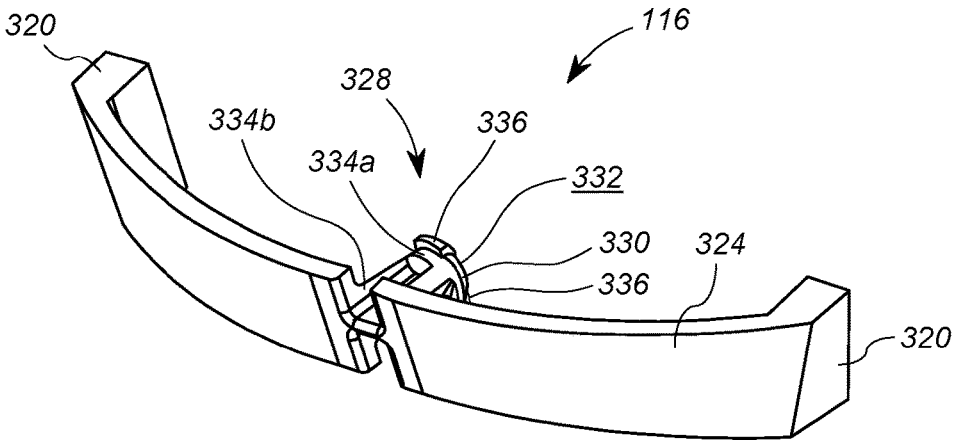
FIG. 10A depicts a partial left side perspective view of one of the end stands of the reel assembly of FIG. 1.
Figure 10B:
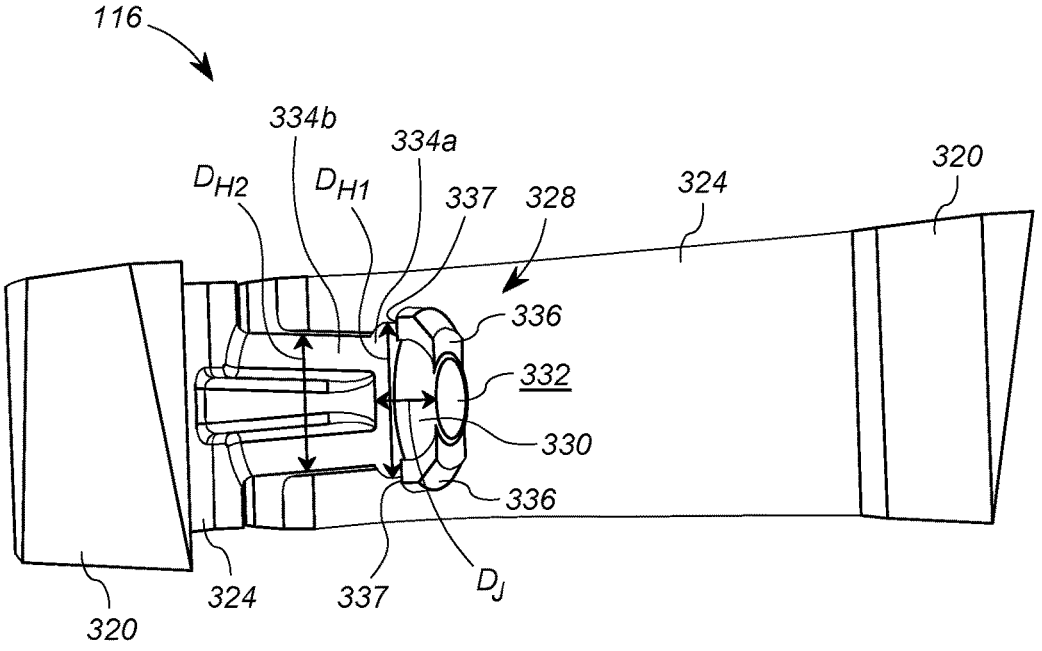
FIG. 10B depicts a partial right side perspective view of one of the end stands of the reel assembly of FIG. 1.

The lock insert 116 is coupled to the spoke ribs 312 of the lock insert spokes 288*a* such that the lock insert 116 spans the space between the lock insert spokes 288*a*. As shown in more detail in FIGS. 10A and 10B, the lock insert 116 includes two lock insert ends 320, configured to be coupled to the spoke ribs 312 (shown in FIGS. 8 and 9), and a curved body 324, which extends between the lock insert ends 320. The curved body 324 is curved in the axial direction such that the curved body 324 is convex toward the outside 264 (shown in FIG. 8) and concave toward the inside 260 (shown in FIG. 9) of the end stand 112. The curved body 324 is also flexible in the axial direction such that the lock insert 116 can be flexed in the axial direction toward and away from the flange 108 (shown in FIG. 1). Though flexible, the curved body 324 is biased toward the convex outside, away from the flange 108, to pull the lock insert 116 away from the flange 108. In other words, the curved body 324 exerts a spring force in the direction away from the flange 108.

The lock insert 116 further includes a lock head 328 spaced evenly between the two insert lock ends 320 in the rotational direction and projecting from the concave side of the curved body 324 in the axial direction. The lock head 328 is substantially cylindrically shaped with a rounded head end 330 having a flat end surface 332 opposite the curved body 324. The lock head 328 also has a first portion 334*a* with a first diameter $D_{H1}$ and a second portion 334*b* with a second diameter $D_{H2}$. The first portion 334*a* is arranged adjacent to the head end 330 and the second portion 334*b* is arranged adjacent to the curved body 324. The head end 330 is shaped as a portion of a sphere having two flat opposing ends, one of which is the end surface 332, and extends from the first portion 334*a* to the end surface 332. The first portion 334*a* is slightly conically shaped such that a smooth transition is formed where the first portion 334*a* meets the head end 330. The slight conical shape of the first portion 334*a* results in the first diameter $D_{H1}$ being slightly smaller immediately adjacent the head end 330 and slightly larger immediately adjacent the second portion 334*b* of the lock head 328. However, the first diameter $D_{H1}$ is larger than the second diameter $D_{H2}$ everywhere along the first portion 334*a*. The lock head 328 has a depth $D_J$ (shown in FIG. 10B) extending from the end surface 332 to the second portion 334*b*. The depth $D_J$ is smaller than the depth $D_L$ at which the lateral portions 200 project into the short side walls 180 of the lock receiver 120 (shown in FIGS. 6A and 6B).

The lock head 328 further includes two locking tabs 336, which project outwardly from the head end 330 in the radial direction from the hub 284 toward the perimeter wall 282 (shown in FIGS. 8 and 9). In other words, the locking tabs 336 project from the head end 330 in a direction that is orthogonal to the rotational direction that the curved body 324 extends between the two lock insert spokes 288*a*. Each of the locking tabs 336 is shaped such that it angles outwardly away from the end surface 332 as it extends along the head end 330 and such that it extends to an end face 337 arranged on the first portion 334*a*. The end faces 337 of the locking tabs 336 are parallel to the end surface 332 and are orthogonal relative to the outer surface of the first portion 334*a*. The end faces 337 project outwardly farther than the first diameter $D_{H1}$ of the first portion 334*a* of the lock head 328.

Figure 11:
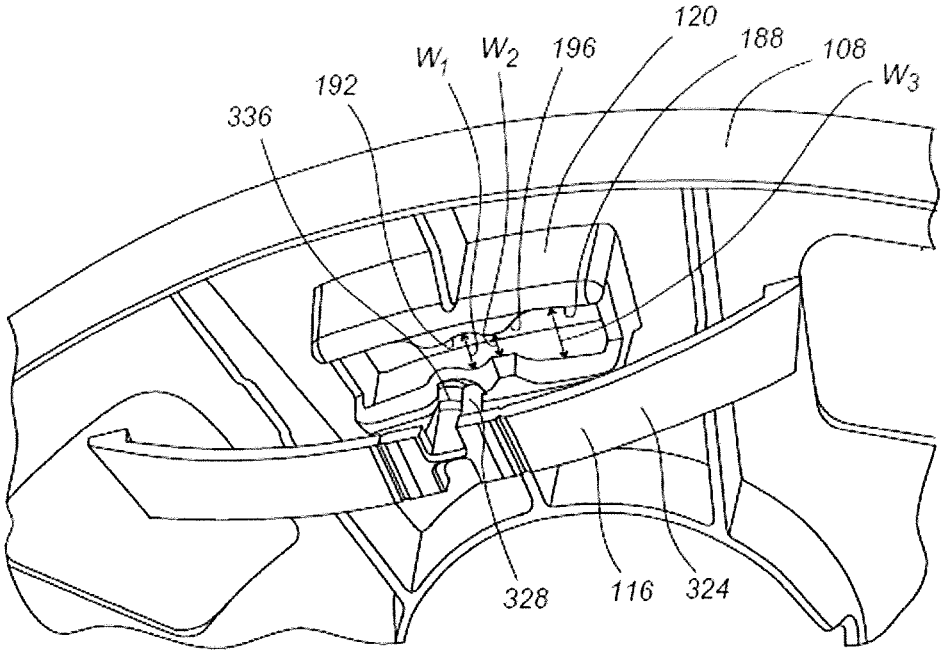
FIG. 11 depicts a partial left side perspective view of one of the end stands and one of the flanges of the reel assembly of FIG. 1 in an unlocked position.
Figure 12:
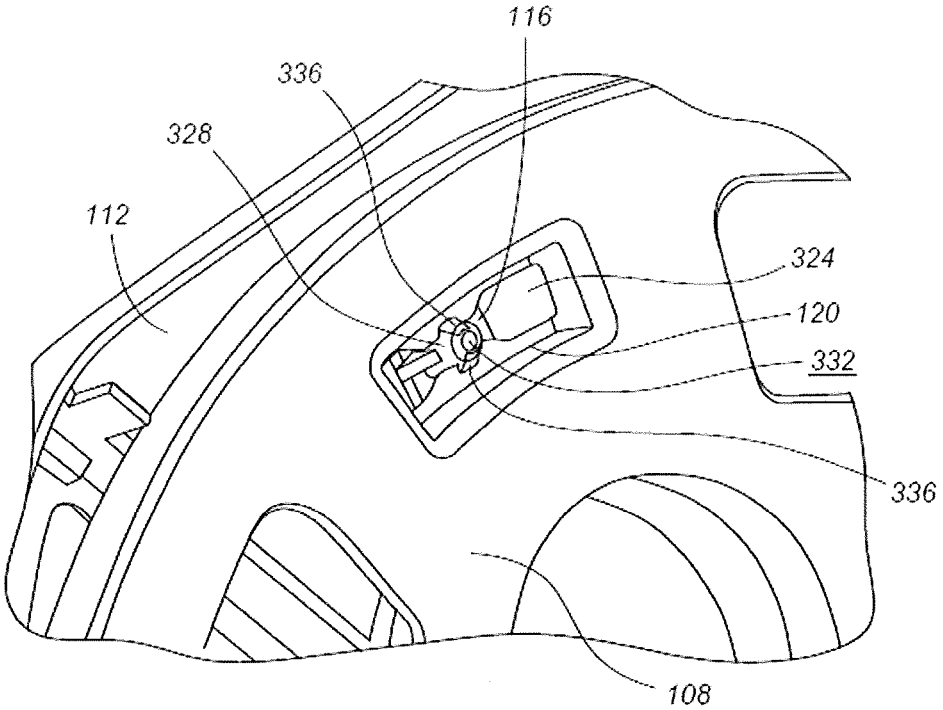
FIG. 12 depicts a partial right side perspective view of one of the end stands and one of the flanges of the reel assembly of FIG. 1 in a locked position.

As shown in FIGS. 11 and 12, the lock insert 116 is configured to engage with the lock receiver 120 on the flange 108 in the axial direction to lock the flange 108 with respect to the end stand 112 in the rotational direction. FIG. 11 depicts the lock insert 116 and a portion of the flange 108 including the lock receiver 120 from the outside 140 of the flange 108. The end stand 112 is not shown in FIG. 11 for clarity. FIG. 12 depicts the lock insert 116 on the end stand 112 and the flange 108 from the inside 136 of the flange 108. In FIG. 11, the lock insert 116 is in a first position, which is a neutral position, wherein the lock insert 116 is not received within the lock receiver 120. In contrast, in FIG. 12, the lock insert 116 is in a second position, which is a flexed position, wherein the curved body 324 is flexed against the spring force and the lock insert 116 is received within the lock receiver 120 on the flange 108. To enable the lock insert 116 to move from the first, unengaged position, shown in FIG. 11, to the second, engaged position, shown in FIG. 12, force greater than the spring force of the curved body 324 is applied to the convex side of the curved body 324 to flex the curved body 324 in the axial direction toward the lock receiver 120 on the flange 108.

The first diameter $D_{H1}$ of the first portion 334*a* of the lock head 328 (shown in FIG. 10B) is slightly smaller than the first opening width W1 of the central portion 192 (shown in FIG. 11) to enable the first portion 334*a* of the lock head 328 to be received within the central portion 192 of the lock receiver 120 of the flange 108 when the curved body 324 is flexed, as shown in FIG. 12. The end faces 337 of the locking tabs 336, however, project outwardly to a distance that is larger than the first opening width W1. Accordingly, when the first portion 334*a* of the lock head 328 is inserted into the central portion 192, (shown in FIG. 12) the spring force of the curved body 324 pulls the lock head 328 outwardly, away from the flange 108. The end faces 337 of the locking tabs 336 contact the locking surface 184 of the lock receiver 120 and enable the locking tabs 336 to resist the spring force of the curved body 324 to retain the lock head 328 within the lock receiver 120. Furthermore, the slight conical shape of the first portion 334*a*, wherein the first diameter $D_{H1}$ is slightly smaller immediately adjacent the head end 330 of the lock head 328, assists in directing the lock receiver 120 to be seated on the first portion 334*a* of the lock head 328 abutting the end faces 337 of the locking tabs 336. This contact between the end faces 337 and the locking surface 184 prevents the lock head 328 from being unintentionally removed in the axial direction from the lock receiver 120. In other words, engagement of the end faces 337 of the locking tabs 336 with the locking surface 184 of the contoured opening 188 prevents the lock head 328 from being unintentionally moved out of the lock receiver 120 in the direction parallel to the longitudinal axis 128 of the core 104 (shown in FIG. 3).

The first diameter $D_{H1}$ of the lock head 328 is slightly larger than the second opening width W2 of the pinched portions 196 of the lock receiver 120. In contrast, the second diameter $D_{H2}$ of the lock head 328 is slightly smaller than the second opening width W2 of the pinched portions 196 of the lock receiver 120. Accordingly, as shown in FIG. 11, when the lock insert 116 is received within the lock receiver 120, the pinched portions 196 on either side of the central portion 192 retain the first portion 334*a* of the lock head 328 within the central portion 192 by interference between the first diameter $D_{H1}$ and the second opening width W2 to prevent the lock head 328 from being unintentionally removed in the rotational direction from the central portion 192. In other words, the pinched portions 196 prevent the lock head 328 from being unintentionally moved out of the lock receiver 120 in the direction perpendicular to the longitudinal axis 128 of the core 104. If, instead, the second portion 334*b* of the lock head 328 were aligned with the pinched portions 196, there would be no interference between the second diameter $D_{H2}$ and the second opening width W2, and the lock head 328 would be free to move rotationally out of the lock receiver 120.

Thus, when the lock insert 116 is received within the lock receiver 120 as shown in FIG. 11, the lock head 328 is trapped axially in the central portion 192 because the spring force of the curved body 324 pulls the lock insert 116 outwardly until the end faces 337 prevent further removal of the lock insert 116 by contact with the locking surface 184, at which point, the first portion 334*a* of the lock head 328 is arranged in the central portion 192. Because the first diameter $D_{H1}$ of the lock head 328 is slightly larger than the second opening width W2 of the pinched portions 196 of the lock receiver 120, the lock head 328 is also trapped rotationally in the central portion 192 due to the interference between the first diameter $D_{H1}$ and the second opening width W2.

The lock head 328 can be inserted into the lock receiver 120 in at least two different ways. Firstly, the end stand 112 can be rotated relative to the flange 108 to align the lock head 328 with the central portion 192 of the lock receiver 120. The lock head 328 can then be forced into the lock receiver 120 by applying sufficient force to the convex side of the curved body 324 to overcome the spring force and to elastically deform the locking tabs 336 inwardly toward the lock head 328 to decrease the diameter of the lock head 328 and/or elastically deform the side walls 180 of the contoured opening 188 inwardly at the first portion 192 to enlarge the first opening width W1 to allow the locking tabs 336 to pass through the first opening width W1. The angle of the locking tabs 336 away from the end face 332 of the lock head 328 and the curved surfaces formed on the outside 140 of the flange 108 along the central portion 192 facilitate passing the locking tabs 336 through the first opening width W1 and into the central portion 192.

Secondly, to insert the lock head 328 into the lock receiver 120, the end stand 112 can be rotated relative to the flange 108 such that the lock head 328 is not aligned with the lock receiver 120, and the lock insert 116 can then be pushed inwardly from the convex side to align the depth $D_J$ of the lock head 328 with the depth $D_L$ of the lateral portions 200 on the side walls 180 of the lock receiver 120. The end stand 112 can then be rotated relative to the flange 108 to pass the depth $D_J$ of the lock head 328 through the depth $D_L$ of the lock receiver 120. When the depth $D_J$ of the lock head 328 is aligned with the depth $D_L$ of the lock receiver 120, the second portion 334*b* of the lock head 328 is aligned with the locking surface 184 of the lock receiver 120. Thus, because the second diameter $D_{H2}$ of the second portion 344*b* of the lock head 328 is smaller than the second opening width W2 of the pinched portions 196 of the lock receiver 120, the lock head 328 is able to pass into the central portion 192 of the lock receiver 120. When the pushing force is removed, the curved body 324 then pulls the lock insert 116 outwardly until the end faces 337 contact the locking surface 184 in the central portion 192.

The lock insert 116 on the end stand 112 is received within the lock receiver 120 on the flange 108, as described above, before the wire is initially wound onto the core 104 (shown in FIG. 3). This prevents the flanges 108 and the core 104 from unintentionally rotating relative to the end stand 112 while the wire is being wound onto the core 104. Additionally, this aligns the offset opening 296 and the offset opening 172 such that the starting end of the wire can be held onto the outer surface 126 of the core 104 as the wire is initially wound onto the core 104. Furthermore, this keeps the core 104, the flanges 108, and the end stands 112 in a fixed configuration as the reel assembly 100, loaded with the wire, is transported to and inserted into the container (shown in FIG. 2). Accordingly, when a user receives the reel assembly 100 within the container 10, as shown in FIG. 2, the lock insert 116 is received within the lock receiver 120 and the flanges 108 are rotationally fixed relative to the end stands 112.

Returning now to FIG. 9, the handle spokes 288*b* are spaced differently in the rotational direction and project at different angles in the radial direction relative to the innermost opening 272 than the spokes 288, including the lock insert spokes 288*a,* to accommodate the handle portion 292. The handle portion 292 is substantially rectangularly shaped and has a length $L_H$ which is substantially equal to the length of the perimeter edge 280 adjacent to the handle portion 292. Thus, the handle portion 292 extends between two corners 308. The handle portion 292 also has a width $W_H$ which projects away from the perimeter edge 280. The length $L_H$ and the width $W_H$ of the handle portion 292 are sized to enable a user to grip the end stand 112 by the handle portion 292. To grip the end stand 112 by the handle portion 292, a user reaches his fingers between the handle spokes 288*b* to the inside 260 of the end stand 112. Thus, the length $L_H$ of the handle portion 292 is sized to comfortably accommodate the user's fingers side-by-side. The outside surface 266 of the end stand 112 at the handle portion 292 then fits into the palm of the user's hand. Thus, the width $W_H$ of the handle portion 292 is sized to fit into the palm of the user's hand. The user's thumb then wraps around the outside of the end stand 112 and contacts the perimeter wall 282. Accordingly, the spacing and angles of the handle spokes 288*b* are configured to intersect with the handle portion 292 and to accommodate the hand of the user.

The handle portion 292 is configured and positioned on the end flange 112 such that, when the reel assembly 100 is received within the container 10, as shown in FIG. 2, the handle portions 292 are aligned with the handle 22 on a respective end 26 of the container 10. The handles 22 are configured to be pushed inwardly, into the container 10, to provide a hand hold surface for the user lifting the container 10. When the reel assembly 100 is received within the container 10, and the handles 22 are pushed inwardly, the handles 22 fold to wrap around the handle portions 292 and contact the inside surfaces 262 of the end stands 112 to enable the user to grasp the handle portions 292 between two layers of the container 10. Accordingly, when the container 10, with the reel assembly 100 retained inside, is lifted by the handles 22, the reel assembly 100 is also lifted by the handle portions 292. This is advantageous because it provides additional support to the reel assembly 100 during lifting and transportation and distributes part of the weight of the reel assembly 100 off of the bottom 14 of the container 10 and onto the handle portions 292. When the handles 22 are wrapped around the handle portions 292 of the end stands 112, the handles 22 do not interfere with the rotation of the flanges 108 relative to the end stands 112.

Figure 13:
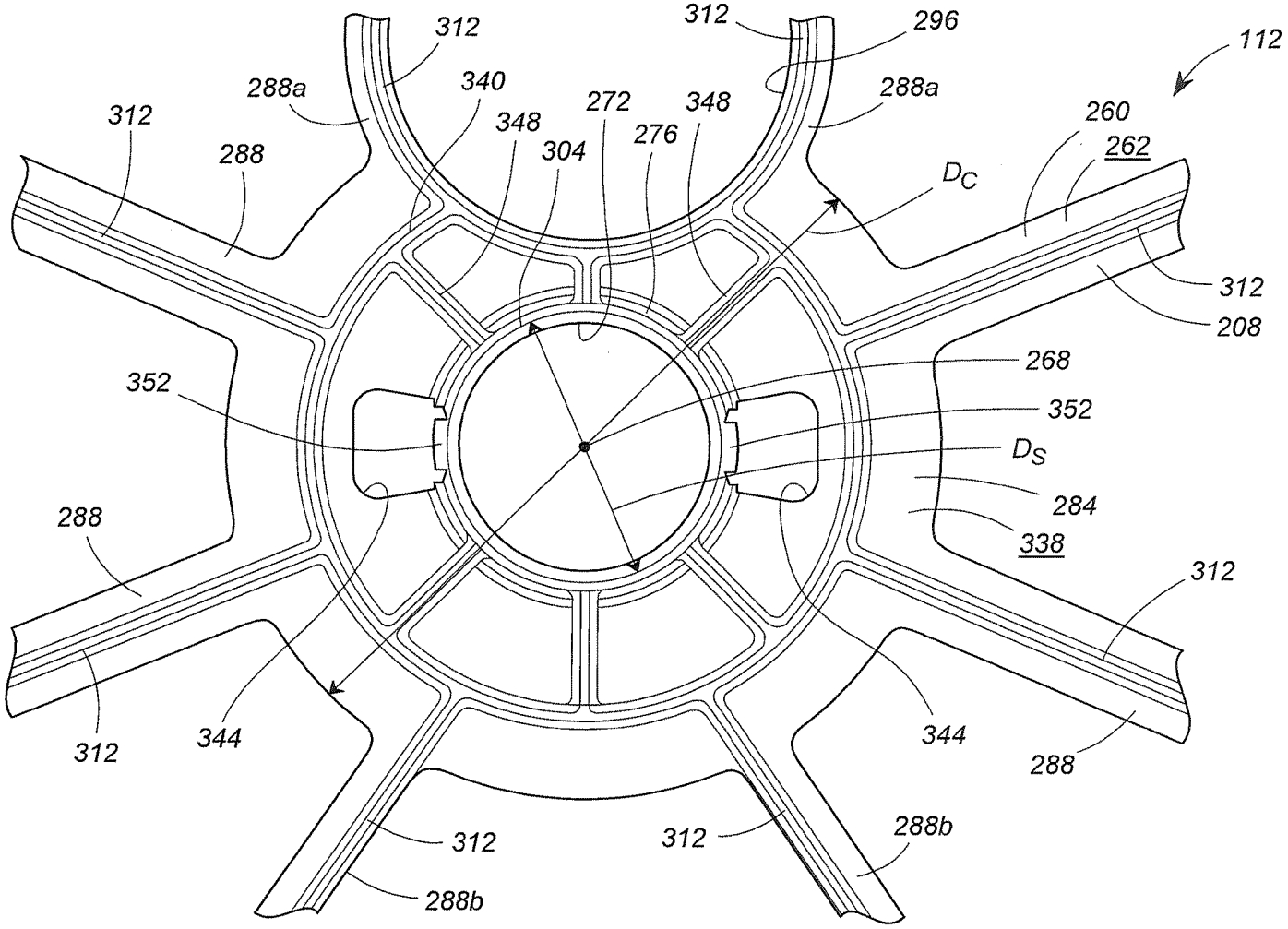
FIG. 13 depicts a partial right side plan view of one of the end stands of the reel assembly of FIG. 1.

Turning now to FIG. 13, a partial view of the inside 260 of the end stand 112 includes an inside surface 338 of the hub 284, which is coplanar with the inside surface 262 of the end stand 112. The inside 260 of the end stand 112 also includes the seat 304 and a hub wall 340, two lateral openings 344, and a plurality of hub ribs 348 on the inside surface 338 of the hub 284. The hub 284 is substantially circular, having a diameter $D_C$, and is arranged concentrically with the rotational axis 268 of the end stand 112. The hub 284 is interrupted by the offset opening 296, however, so the hub 284 is not completely circular. The hub wall 340 projects the depth $D_P$ (shown in FIG. 9) from the inside surface 338 of the hub 284 in the axial direction away from the outside 264 of the end stand 112. The hub wall 340 is also substantially circular and is arranged concentrically within the hub diameter $D_C$ and outside the innermost opening 272. The hub wall 340 is also interrupted by the offset opening 296, and, like the hub 284, is not completely circular.

Each of the spokes 288, including the handle spokes 288*b,* but not the lock insert spokes 288*a,* intersects with the hub 248, and each of the spoke ribs 312, except for those on the lock insert spokes 288*a,* intersects with the hub wall 340. The spokes 288 thus connect the hub 248 to the perimeter edges 280 (shown in FIGS. 8 and 9) and provide strength and structural support to the hub 248 and the perimeter edges 280. The spoke ribs 312 connect the hub wall 340 to the perimeter walls 282 (shown in FIGS. 8 and 9) and provide strength and structural support to the hub wall 340 and the perimeter walls 282.

The hub 284 also includes the hub ribs 348 formed on the inside surface 338 of the hub 248 and extending in the radial direction from the hub wall 340 to the innermost opening wall 276. The hub ribs 348 project the depth $D_P$ (shown in FIGS. 8 and 9) from the inside surface 338 of the hub 284 in the axial direction away from the outside 264 of the end stand 112. The hub ribs 348 provide strength and structural support to the hub wall 340, and thus the spoke ribs 312, and to the innermost opening wall 276.

The seat 304 projects a depth $D_T$ (shown in FIG. 9) from the innermost opening wall 276 in the axial direction. In other words, the seat 304 projects the depth $D_T$ farther than the innermost opening wall 276, which projects the depth $D_P$ from the inside surface 338 of the hub 284, in the axial direction toward the flange 108 and the core 104 when the reel assembly 100 is assembled as shown in FIG. 1. The seat 304 also has a diameter $D_S$ which is slightly smaller than a diameter $D_O$ (shown in FIG. 5) of the innermost opening 148 of the flange 108, which enables the seat 304 on the end stand 112 to fit within the innermost opening wall 152 surrounding the innermost opening 148 of the flange 108 (shown in FIGS. 4 and 5). The depth $D_T$ of the seat 304 provides surface contact area between the seat 304 and the innermost opening wall 152 of the flange 108 along the further depth $D_G$ of the innermost opening wall 152 when the seat 304 of the end stand 112 is fitted within the innermost opening wall 152 of the flange 108. As shown in FIG. 9, the depth $D_T$ of the seat 304 combined with the depth $D_P$ of the innermost opening wall 276 of the end stand 112 is larger by a distance $D_R$ (shown in FIG. 9) than the further depth $D_G$ of the innermost opening wall 152 of the flange 108 (shown in FIG. 5).

The seat 304 is made of a material which is able to flex slightly under pressure and return to its original shape when the pressure is removed. As shown in FIG. 13, the seat 304 includes two projecting tabs 352 which project outwardly from opposite sides of the seat 304 in a neutral position. The projecting tabs 352 are arranged at the end of the seat 304 that is farthest from the innermost opening wall 276 and the hub 284 of the end seat 112. The projecting tabs 352 are configured to flex slightly toward the seat 304 to a flexed position under pressure, and then to return to the neutral position when pressure is removed. The projecting tabs 352 have a depth that is slightly smaller than the distance $D_R$.

The lateral openings 344 are two openings formed through the hub 284 and the innermost opening wall 276 on opposite sides of the innermost opening wall 276. The lateral openings 344 are formed through the entire depth $D_P$ of the innermost opening wall 276 up to the seat 304 and are aligned with the projecting tabs 352 which project from the seat 304. The lateral openings 344 are sized to enable the seat 304 to be reached through the lateral openings 344 from the outside 264 of the end stand 112 on opposite sides of the innermost opening wall 276. Reaching opposite sides of the innermost opening wall 276 enables opposite sides of the seat 304 to be pressed radially inwardly toward one another to flex the seat 304 such that the diameter $D_S$ of the seat 304 is made slightly smaller and the projecting tabs 352 are made slightly nearer to one another. Thus, the lateral openings 344 enable the seat 304 to be flexed to the flexed position from the outside 264 of the end stand 112.

The seat 304 is configured to engage the innermost opening wall 152 (shown in FIG. 5) of the flange 108 to couple the end stand 112 to the flange 108 by inserting the seat 304 into the innermost opening 148 (shown in FIG. 5). Because the diameter $D_S$ of the seat 304 is slightly smaller than the diameter $D_O$ (shown in FIG. 5) of the innermost opening 148 of the flange 108, the seat 304 slides along the innermost opening wall 152 in the axial direction, and the projecting tabs 352 are slightly compressed inwardly in the radial direction by contact with the innermost opening wall 152. When the seat 304 is fully inserted into the innermost opening 148, the seat projects by the distance $D_R$ (shown in FIG. 9) beyond the further depth $D_G$ (shown in FIG. 5) of the innermost opening wall 152. Because the projecting tabs 352 have a depth that is slightly smaller than the distance $D_R$, when the seat 304 is fully inserted into the innermost opening 148, the projecting tabs 352 are positioned beyond the innermost opening wall 152 on the side of the innermost opening wall 152 that is farthest from the inside surface 164 of the flange 108. Because the projecting tabs 352 are configured to return to the neutral position when pressure is removed, once the projecting tabs 352 are positioned beyond the innermost opening wall 152, the projecting tabs 352 extend outwardly from the seat 304 to trap the innermost opening wall 152 of the flange 108 on the seat 304 between the projecting tabs 352 and the hub wall 340 and hub ribs 348.

When the innermost opening wall 152 of the flange 108 is trapped on the seat 304, the seat 304 has engaged the innermost opening wall 152 of the flange 108. In this engaged configuration, the flange 108 rests on the hub wall 340 and hub ribs 348 of the end seat 112 such that the flange 108 is able to slide along the hub wall 340 and hub ribs 348 when the flange 108 rotates relative to the end seat 112. When the flange 108 and end seat 112 are in this engaged configuration, the lock insert 116 on the end stand 112 and the lock receiver 120 on the flange 108 are spaced apart from one another such that the lock insert 116 can be unengaged from the lock receiver 120, as shown in FIG. 11, or engaged with the lock receiver 120, as shown in FIG. 12.

To assemble the reel assembly 100 for use, as shown in FIG. 1, first the core 104 is coupled to the flanges 108 by inserting each end 132 of the body 124 of the core 104 into the gap 220 between the inner core engaging wall 212 and the outer core engaging wall 216 of a flange 108. Thus, the flanges 108 are coupled to the core 104 in the axial direction. To further retain the core 104 on the flanges 108, fasteners can then be inserted in the radial direction through the outer surface 222 of the outer core engaging wall 216, through the body 124 of the core 104, and, optionally, also through the inner core engaging wall 212. Once a flange 108 is coupled to each end 132 of the core 104, an end stand 112 is coupled to each flange 108. To couple the end stand 112 to a respective flange 108, opposite sides of the seat 304 are compressed in the radial direction to the flexed position through the lateral openings 344 on the end stand 112 to bring the projecting tabs 352 of the seat 304 slightly nearer to one another. Then, while being slightly compressed, the seat 304 of the end stand 112 is inserted in the axial direction into the innermost opening wall 152 of the flange 108. Once inside the innermost opening wall 152 of the flange 108, the seat 304 remain slightly compressed by contact between the projecting tabs 352 and the innermost opening wall 152 as the seat 304 is slid into the innermost opening wall 152. Once the projecting tabs 352 are positioned beyond the innermost opening wall 152, the seat 304 is no longer compressed by the innermost opening wall 152, enabling the projecting tabs 352 to return to the neutral position, thereby locking the innermost opening wall 152 onto the seat 304 between the projecting tabs 352 and the hub wall 340 and hub ribs 348. Thus, the end stands 112 are coupled to the flanges 108 in the axial direction.

When both end stands 112 are coupled to the flanges 108 in this manner, the reel assembly 100 is complete. Next the flanges 108 can be fixed in the rotational direction relative to the end stands 112 by locking the lock inserts 116 into the lock receivers 120 using one of the two methods described above. In at least one embodiment, it is only necessary to one lock insert 116 into its respective lock receiver 120 to rotationally fix the flanges 108 relative to the end stands 112 because the flanges 108 are fixed relative to one another via their connection to the core 104. However, to further ensure that the flanges 108 do not rotate relative to the end stands 112, both lock inserts 116 can be engaged with their respective lock receivers 120.

Once the reel assembly 100 is assembled and the flanges 108 are rotationally locked relative to the end stands 112, the reel assembly 100 can easily be lifted and transported by the handle portions 292 on the end stands 112. Additionally, the end stands 112 can be gripped and held stationary while wire is wound onto the core 104 without rotating the flanges 108 relative to the end stands 112. In at least one alternative embodiment, it is not necessary to lock the flanges 108 relative to the end stands 112 prior to winding the wire onto the core 104. In such embodiments, the flange 108 is gripped and held stationary while the wire is wound onto the core 104, thus preventing rotation of the flanges 108 relative to the end stands 112. To wind the wire onto the core 104, a starting end of the wire is fed into the offset opening wall 232 of the flange 108 and is available to be grasped from outside the end stand 112. The starting end of the wire is thus held onto the outer surface 126 of the core 104 and the wire is wound onto the core 104 on top of the starting end. When the wire has been wound onto the core 104, the starting end of the wire is released and is positioned within the offset opening 172 and the offset opening 296. The free end of the wire is spaced apart from the outer surface 126 of the core 104 by the length of wire between the starting end and the free end, and the free end is free to be grasped by a user. The free end of the wire can either be grasped and pulled by the user through an opening (not shown) formed in one of the sides 18 of the container 10 or through the open top 30 of the container 10.

Once the reel assembly 100 is assembled and the wire has been wound onto the core 104 between the two flanges 108, the reel assembly 100 can be received within the container 10 such that the perimeter walls 282 contact the bottom 14 and each of the sides 18 of the container 10. The container 10 and the reel assembly 100 can then be lifted together by the handles 22 and the handle portions 292.

Once the reel assembly 100 and container 10 have been transported to a location for use, the flanges 108 are rotationally unlocked relative to the end stands 112 to enable rotation of the flanges 108 and the core 104 with respect to the end stands 112 and allow wire to be unwound from the core 104. To unlock the flanges 108, the free end of the wire is pulled away from the reel assembly 100. Pulling the free end of the wire applies a rotational force in an unwinding direction to the core 104, which is translated to a rotational force in the unwinding direction on the flanges 108. When the rotational force is larger than the force retaining the lock head 328 within the pinched portions 196, the rotational force on the flanges 108 rotates the lock head 328 past the pinched portion 196 and rotates the lock receiver 120 relative to the lock insert 116.

More specifically, the rotational force on the flanges 108 is greater than the material strength of at least one of the first portion 334*a* of the lock head 328 and side walls 180 of the contoured opening 188 at the pinched portions 196 such that at least one of the lock head 328 and the pinched portion 196 is elastically deformed until the lock head 328 is smaller than the pinched portion 196 in the direction of rotation. Additionally, the rotational force on the flanges 108 is greater than the frictional force between the lock head 328 and the pinched portion 196. Thus, the rotational force is great enough to enable the first diameter $D_{H1}$ of the first portion 334*a* of the lock head 328 to pass through the second opening width W2 of the pinched portion 196 and into the third opening width W3 of the respective lateral portion 200. The lock head 328 then passes freely through the lateral portion 200 and out of the respective short side wall 180 of the contoured opening 188. The depth $D_L$ of the lateral portion 200 helps to prevent the lock head 328 from getting caught on the short side wall 180 as it passes out of the contoured opening 188. Once the lock head 328 is no longer received within the contoured opening 188, the lock insert 116 is no longer engaged with the lock receiver 120, and the flanges 108 are free to rotate relative to the end stands 112.

In an alternative embodiment, the flanges 108 can be unlocked from the end stands 112 by forcing the lock head 328 further into the lock receiver 120. In this embodiment, the first portion 334*a* has a slight inverse conical shape such that the first diameter $D_{H1}$ is slightly smaller immediately adjacent the second portion 334*b* and slightly larger immediately adjacent the head end 330 of the lock head 328. In this embodiment, as the rotational force on the flanges 108 overcomes the material forces and frictional forces of the lock head 328 and the pinched portion 196, the slight inverse conical shape guides the lock head 328 inwardly relative to the lock receiver 120. Once the lock head 328 has been guided inwardly far enough, the first portion 334*a* is further inward than the pinched portions 196, and the pinched portions 196 are aligned with the second portion 334*b* of the lock head 328. Because the second diameter $D_{H2}$ of the second portion 334*b* is smaller than the first diameter $D_{H1}$ of the first portion 334*a*, when the pinched portions 196 are aligned with the second portion 334*b*, the lock head 328 is free to rotate out of the lock receiver 120. In this embodiment, the rotational force generates an inward force on the lock head 328 that is greater than the outward force applied by the curved body 324. In this embodiment, when the first portion 334*a* of the lock head 328 is aligned with the pinched portions 196, the lock insert 116 is in a first axial position, and when the second portion 334*b* of the lock head 328 is aligned with the pinched portions 196, the lock insert 116 is in a second axial position. When the lock insert 116 is in the first axial position, the flange 108 is rotationally locked relative to the end stand 112. When the lock insert 116 is in the second axial position, the flange 108 is not rotationally locked relative to the end stand 112.

If the user desires to wind some of the wire back onto the core 104, the user manually rotates the flanges 108 and the core 104 in a winding direction, opposite the unwinding direction. During rotation in the winding direction, the starting end of the wire, which has been unrestrained and free to move with the offset opening 172 and the offset opening 296, is contacted by the offset opening wall 232 of the offset opening 172. The notch 236 in the offset opening wall 232 is arranged and configured such that rotation of the flange 108 in the winding direction causes the starting end of the wire to be guided by the guide edge 246 into the notch 236 so that the starting end of the wire does not get caught between the flange 108 and the end stand 112 as the flange 108 is rotated or otherwise interfere with winding the wire back onto the core 104.

What is claimed is:

1. A reel assembly, comprising:

a core defining a longitudinal axis and having two ends;

first and second flanges, each flange configured to be coupled to one of the two ends of the core, the first flange including a lock receiver; and first and second end stands, each end stand configured to be coupled to a respective one of the first and second flanges, the first end stand including a lock insert, wherein the lock insert is configured to be alternately disposed in a first axial position received by the lock receiver and disposed in a second axial position apart from the lock receiver, and wherein when the lock insert is in the first axial position, contact between the lock insert and the lock receiver generates a force opposing movement of the first and second flanges relative to the first and second end stands in a rotational direction orthogonal to the longitudinal axis.

2. The reel assembly of claim 1, wherein:

the lock insert is spring biased toward the second axial position, and the lock receiver is configured to retain the lock insert in the first axial position.

3. The reel assembly of claim 2, wherein:

the lock receiver includes at least one first portion having a first width and at least one second portion having a second width, the first width larger than the second width, the lock insert includes a first portion having a first diameter and a second portion having a second diameter, and the first diameter is larger than the second width and the second diameter is smaller than the second width.

4. The reel assembly of claim 3, wherein:

the lock receiver further includes at least one third portion having a third width, the lock insert further includes a tab portion having a tab diameter, and the tab diameter is larger than the first width and the second width and is smaller than the third width.

5. The reel assembly of claim 3, wherein:

the first diameter is smaller near the second portion of the lock insert and larger apart from the second portion of the lock insert, the second diameter is smaller than the first diameter, and rotation of the lock insert relative to the lock receiver forces the first portion of the lock insert inwardly relative to the lock receiver.

6. The reel assembly of claim 3, wherein:

the lock insert is in a first axial position when the first portion of the lock insert is arranged in the at least one first portion of the lock receiver, the lock insert is in a second axial position when the second portion of the lock insert is arranged in the at least one first portion of the lock receiver, and rotation of the lock insert relative to the lock receiver forces the lock insert from the first axial position to the second axial position.

7. The reel assembly of claim 1, wherein:

the lock receiver includes at least one first portion having a first width and at least one second portion having a second width, the first width larger than the second width, and the lock insert has a lock diameter that is smaller than the first width and the second width.

8. The reel assembly of claim 7, wherein contact between the lock insert and the at least one second portion of the lock receiver generates the force opposing movement of the first and second flanges relative to the first and second end stands.

9. The reel assembly of claim 8, wherein:

movement of the flanges relative to the end stands in the rotational direction generates a rotational force, and when the rotational force is greater than the force opposing movement of the first and second flanges relative to the first and second end stands, the lock insert is removed from the lock receiver in the rotational direction.

10. The reel assembly of claim 9, wherein:

the lock receiver further includes at least one third portion having a third width, and the third width is larger than the first width and larger than the second width.

11. The reel assembly of claim 10, wherein when the rotational force is greater than the force opposing movement of the first and second flanges relative to the first and second end stands, the lock insert is removed from the lock receiver via the at least one third portion.

12. The reel assembly of claim 10, wherein the at least one second portion is interposed between the at least one first portion and the at least one third portion of the lock receiver.

13. The reel assembly of claim 7, wherein:

the lock insert includes at least one lock tab configured to be positioned in a neutral position projecting outwardly from the lock insert beyond the lock diameter to a larger diameter, the at least one lock tab is configured to flex under applied pressure to a flexed position projecting outwardly from the lock insert beyond the lock diameter to a smaller diameter, and the larger diameter is larger than the first width and the smaller diameter is smaller than the first width.

14. The reel assembly of claim 9, wherein the smaller diameter is larger than the second width.

15. The reel assembly of claim 1, wherein:

the core has a body having a thickness, each of the flanges includes a circular outer wall having an outer wall diameter and a circular inner wall having an inner wall diameter that is smaller than the outer wall diameter, the inner wall is arranged concentrically within the outer wall with a gap interposed between the inner wall and the outer wall, and the gap is larger than the thickness and is configured to receive the body of the core therein.

16. The reel assembly of claim 1, wherein:

each of the flanges includes an innermost opening with an innermost opening diameter, each of the end stands includes a seat projecting from the end stand, and the seat has a seat diameter that is smaller than the innermost opening diameter.

17. The reel assembly of claim 16, wherein:

the seat includes at least one tab configured to be positioned in a neutral position projecting outwardly from the seat beyond the seat diameter to a larger seat diameter, the at least one tab is configured to flex under applied pressure to a flexed position projecting outwardly from the seat beyond the seat diameter to a smaller seat diameter, and the larger seat diameter is larger than the innermost opening diameter and the smaller seat diameter is smaller than the innermost opening diameter.

18. The reel assembly of claim 17, wherein:

the innermost opening is bordered by an innermost opening wall having a first depth, the seat has a second depth that is larger than the first depth by a difference, the at least one tab has a tab depth which is smaller than the difference.

* * * * *